United States Patent [19]

Purinton, Jr.

[11] 4,254,559

[45] Mar. 10, 1981

[54] METHOD FOR DRYING PIPELINES

[75] Inventor: Robert J. Purinton, Jr., Tulsa, Okla.

[73] Assignee: The Dow Chemical Company, Midland, Mich.

[21] Appl. No.: 122,536

[22] Filed: Feb. 19, 1980

[51] Int. Cl.[3] ..... F26B 3/00

[52] U.S. Cl. ..... 34/9; 34/12

[58] Field of Search ..... 34/9, 12; 166/283

[56] References Cited

U.S. PATENT DOCUMENTS

| | | | |
|---|---|---|---|
| 4,003,393 | 2/1977 | Jaggard et al. | 137/15 |
| 4,210,206 | 7/1980 | Ely et al. | 166/283 |

*Primary Examiner*—John J. Camby

*Attorney, Agent, or Firm*—L. Wayne White

[57] ABSTRACT

The interior surface of a pipeline is dried by sequentially passing through the pipeline (a) an aqueous cross-linked gelled pig, (b) a fluid mobility buffer comprising a non-crosslinked gelled ankanol of from one to three carbon atoms, (c) a dessicating amount of a liquid alkanol from one to three carbon atoms. For example, a pipeline was dried by sequentially passing through it (a) a borate cross-linked hydroxypropyl guar gum pig, (b) a fluid mobility buffer comprising methanol thickened with hydroxypropyl cellulose, and (c) methanol.

10 Claims, No Drawings

METHOD FOR DRYING PIPELINES

BACKGROUND OF THE INVENTION

1. Field of the Invention

This invention pertains to a novel method of drying pipelines which utilizes gelled pigs in combination with a dessicating alkanol in both gelled and liquid form.

2. Description of the Prior Art

Pipeline efficiency and volume can be lost by scale build-up in the interior linings of the pipe. In many instances, this scale also contains bacteria which attack the commodity to be transmitted by the pipeline. For example, sulfate-reducing bacteria can generate copious quantities of hydrogen sulfide on certain crude oils. Hydrogen sulfide is a noxious, toxic gas which makes the material difficult or dangerous to handle from a personnel standpoint and also from a pumping standpoint. Undissolved gases in a liquid can cause pumps to cavitate, lose prime, or to function less efficiently overall. Still other bacteria are known to consume hydrocarbons and result in a loss of product and cause some of the processing difficulties mentioned above.

Mechanical pigs and/or gelled chemical pigs have been used to remove the scale. The mechanical pigs are normally solid bullet-shaped devices which have wire brushes or abrasive surfaces to physically abrade the scale interior from the pipe. The gelled chemical pigs, on the other hand, remove the surface deposits by dissolution and/or by picking up loose debris as they pass through the pipeline.

A new aqueous gelled pig containing bactericides was described in a commonly owned co-pending patent application filed by Robert J. Purinton, Jr. on Nov. 20, 1979, entitled "Gelled Pigs for Cleaning and Sanitizing Pipelines", Ser. No. 096,106, the disclosure of which is incorporated herein by reference. The gelled pigs described there are extremely effective in removing bacteria-containing scale from pipelines.

Still other aqueous cross-linked gelled pigs for cleaning pipelines were described by Robert J. Purinton, Jr. in a U.S. patent application entitled "Aqueous Cross-linked Gelled Pigs for Cleaning Pipelines" filed December, 1979 (Attorney Docket No. C-27,974), the disclosure of which is incorporated herein by reference.

The pigs described in each of these applications by Purinton are effective in cleaning pipelines, but as noted by Z. A. Popan, Pipeline Gas Journal, Volume 204, No. 14, 20 (December, 1977), because water is an undesirable foreign matter in any oil or gas pipeline, the cleaning of pipelines should be associated with their drying. One method of drying the pipeline was described by G. D. H. Crawford, Gas Journal, Volume 341, No. 5549, 282 Mar. 18, 1970). Crawford removed the bulk of the water from the pipeline by conventional pigging using mechanical pigs and then swabbed the interior of the pipeline by passing a quantity of methanol through the pipeline sandwiched between pigs. Crawford found it necessary to use this technique to remove residual water from pipelines carrying natural gas having a high proportion of methane. Residual water was said to form hydrates with the methane under certain conditions of temperature and pressure and lead to serious transmission difficulties.

SUMMARY OF THE INVENTION

A new method of drying the interior surface of a pipeline has now been discovered which comprises sequentially passing through said pipeline:

(a) an aqueous cross-linked gelled pig, (b) a fluid mobility buffer comprising a non-cross-linked gelled alkanol of from one to three carbon atoms, and (c) a dessicating amount of a liquid alkanol of from one to three carbon atoms.

The mobility buffer (b) permits the user to derive the benefits of both the gelled aqueous pigs and a liquid dessicating alkanol. This unique combination results in a superior method or drying pipelines.

DETAILED DESCRIPTION OF THE INVENTION

Component (a) is an aqueous cross-linked gelled pig. The aqueous-based pig composition comprise water, a thickening agent, and a crosslinker. It may optionally contain other additives, such as sand, which promote the cleaning ability of the pig as it passes through the pipeline, conventional stabilizers for the polymeric thickening agent, bactericides, etc.

Thickeners for water-based fluids are well known. The most common thickeners are galactomannan gums and derivatives thereof. Examples of such gums include natural gums such as guar gum, locust bean gum, endosperm seed gums, and the like, and derivatives thereof, such as hydroxyalkyl galactomannans, carboxyalkyl galactomannans, hydroxyalkyl carboxyalkyl galactomannans, and other such derivatives are also useful in many instances. The most common commercial galactomannans are guar gum, hydroxypropyl guar, hydroxyethyl guar, hydroxyethyl carboxymethyl guar, and carboxymethyl guar gum. Because of the commercial availability, these gums are the preferred thickeners. It should be noted that in some references the galactomannan gums are referred to as polysaccharide and polysaccharide derivatives. Any member of this known class of thickening agents can be used in the instant invention. Such thickeners are normally used in amounts from about 40 to about 150 pounds per 1,000 gallons of water (i.e. from about 0.5 to about 1.8 percent by weight). They are preferably used in amounts of from about 60 to 80 pounds per 1,000 gallons of water (i.e. from about 0.75 to about 1 percent by weight). The actual amount used, however, can be adjusted to convenience by the practitioner.

Aqueous compositions containing the above thickeners are normally cross-linked using a polyvalent metal ion. The cross-linker is normally added as a soluble salt or as a soluble organometallic compound in an amount sufficient to achieve the desired amount of cross-linking. Borates, organotitanates, and organozirconium salts are commonly used. The cross-linking ability of such compounds is pH dependent in many instances (e.g. the borate systems). This factor presents a convenient mechanism for dealing with the thickened fluids in a non-crosslinked form until the properties of a cross-linked fluid are desired. In the non-crosslinked state, the thickened aqueous fluids are normally pumpable at conventional pressures. Substantially elevated pressures are required to pump the fluids in the cross-linked state.

The galactomannan gums and cross-linkers are, as noted, known classes of compounds which are illustrated in U.S. Pat. No. 3,058,909, U.S. Pat. No.

3,974,077, U.S. Pat. No. 3,818,991, U.S. Pat. No. 3,779,914, and U.S. Pat. No. 3,696,035, the disclosures of which are incorporated by reference. Reference is also made to the disclosure in the text by Davidson and Sittig, "Water-Soluble Resins" 2nd Edition (1968) and the text by Smith and Montgomery, "The Chemistry of Plant Gums and Mucilages", Biograph Series No. 141 (1959).

Normally, the pig is formulated outside of the pipeline as a pumpable mass and the cross-linker or cross-linker/activator is added to the pumpable mass as it is being pumped into the pipeline. This "on-the-fly" approach has several procedural advantages, not the least of which is ease of placement at convenient low pressures. In this manner, the pig forms a cross-linked gel network after it enters the pipeline and conforms to the general shape and size of the pipeline. To illustrate, an aqueous pig comprised of a borate cross-linked polysaccharide (or polysaccharide derivative) gel is a preferred pig composition where the pig may be subjected to considerable shear. Such pig formations are conveniently prepared and used by first blending boric acid (about 2 to 4 pounds) with an aqueous slurry or solution of the polysaccharide or polysaccharide derivative (about 60 to 80 pounds) to form a pumpable homogeneous mass. Sufficient base (e.g. aqueous NaOH) is then metered in to change the pH to a basic pH (pH 8.5–10 normally) as the homogeneous aqueous mass is being pumped into the pipeline. The quantities of boric acid and polysaccharide or derivative are per 1,000 gallons of water in each instance. The gel-time of these borate-crosslinked systems is easily adjusted by the quantity of base added (cross-linking occurs faster at higher pH values).

Component (b) is a fluid mobility buffer comprising a non-crosslinked gelled alkanol of from one to three carbon atoms. Preferred alkanols are methanol, ethanol, and isopropanol. Mixtures of alkanol can be used, if desired. The thickening agent for such alkanols can be galactomannan gums or derivatives thereof but are preferably hydroxy (lower alkyl) celluloses and are more preferably hydroxyethyl or hydroxypropy cellulose. Such thickeners may be included in the alkanol in substantially any concentration that has the effect of gelling the alkanol and thereby lowering its volatility and enabling the gelled material to be pumped as a viscous slug through the pipeline. Concentrations of from about 50 pounds to about 200 pounds of thickener per thousand gallons of alkanol are normally used in making component (b). Sodium hydroxide or other strong base can also be added to component (b) as a viscosity enhancer.

Component (b) separates the aqueous gelled pig from the liquid alkanol and prevents interfacial mixing of these two components which would destroy or substantially reduce the effectiveness of each. The gelled alkanol does not appear to cause degradation of the gelled aqueous pig (e.g. by dehydration, etc.) even though the gelled alkanol has capacity to take up substantial quantities of water as it passes through the pipeline.

Component (c) is a liquid alkanol of from one to three carbon atoms. Preferred alkanols are methanol, ethanol and ispropanol. The alkanol(s) is used in an amount sufficient to dry the pipeline to the desired degree of dryness, i.e. a dessicating amount.

It is preferred that the alkanol in component (b) and component (c) be the same, but they may be different at the convenience of the user. For example, one would ordinarily prefer to follow gelled methanol with liquid methanol, but it would likewise be satisfactory to follow gelled methanol with ethanol or isopropanol.

It is normally convenient to follow liquid component (c) with an mechanical swab or with a cross-linked hydrocarbon gel (e.g. the gelled hydrocarbon pigs described in U.S. Pat. No. 4,003,393) or an ungelled hydrocarbon pig (e.g. the materials described in U.S. Pat. No. 4,152,289), but the use of an inert gas is also operable.

Components (a), (b) and (c) are normally driven through the pipeline by a driving force of a fluid under pressure. This fluid may be gas or a liquid or a gelled hydrophobic liquid or a combination thereof and will vary depending upon the needs of the user. For example, if the user wishes to leave the pipeline in a dry, empty state, one would normally use a dry inert gas (e.g. nitrogen, carbon dioxide, ethane, propane, liquified petroleum gas, etc.). If the user desires to refill the pipeline with a product, the "pig train" could be driven with a liquid product (e.g. crude oil, gasoline, etc.) so long as there was a satisfactory interface between the product and the alkanol such that the product did not adversely affect the dessicating ability of the alkanol before the job was complete or substantially complete in the pipeline.

Normally, the pig train of components (a), (b), and (c) are used in pipelines which are at ambient temperatures or less and the pig train is propelled through the pipeline at rates of from about 1 to about 5 feet per second or more. The rate will be as high as is feasible without destroying the effectiveness of the pig train and is governed in a large part by the pressure capacity of the pipeline. Driving pressures of up to about 1,500 psig are normally used but driving pressures up from about 50 to about 500 psig are more common.

The pig train of components (a), (b) and (c) can be preceded by other pig segments if desired. For example, the pig train could be preceded by a mechanical pig, an aqueous gelled pig containing an abrasive, a gelled aqueous pig containing a bactericide, etc. or combinations thereof.

EXPERIMENTAL

The following example will further illustrate the invention.

EXAMPLE 1

Approximately 60 feet of a 1-inch steel pipeline, containing 25 feet of clear polyvinyl chloride sections was filled with water, evacuated with compressed air, and then dried by passing through it the following pig train:

(1) A crosslinked gelled water pig was added first. It was prepared by mixing 12 gallons (gal.) water, 354 grams (g.) of hydroxypropyl-guar, 16.5 g. boric acid, and lastly, 350 milliliters (mL.) of a 5 percent solution of sodium hydroxide in water. The sodium hydroxide was added on-the-fly as the pig was being pumped into the line. The pig crosslinked quickly (2–5 seconds) after entering the line to a firm gel.

(2) A gelled methanol pig—prepared by blending 3.5 gal. methanol, 191 g. of hydroxypropyl cellulose (average molecular weight of approximately 1 million) and 24 g. solid sodium hydroxide—was then charged.

(3) Methanol—15 gal.

The pig train was then driven through the line at 1-2 feet per second with compressed nitrogen (approximately 231 standard cubic feet used).

Visual inspection of the line prior to drying showed the walls wet with water and small puddles in low points of the line. After drying with the pig train, the surface walls had a dew point of −19° F. as measured by the Bureau of Mines Dew Point Tester (manufactured by Chandler Engineering Company).

What is claimed is:

1. A method of drying the interior surface of a pipeline comprising sequentially passing through said pipeline:

(a) an aqueous cross-linked gelled pig, (b) a fluid mobility buffer comprising a non-cross-linked gelled alkanol of from one to three carbon atoms, and (c) a dessicating amount of a liquid alkanol of from one to three carbon atoms.

2. The method defined by claim 1 wherein (a) is a gelled pig comprising a galactomannan gum or derivative thereof.

3. The method defined by claim 2 wherein (a) is a gelled pig comprising a guar gum or hydroxypropyl guar gum crosslinked with borate, titanate or zirconium ions.

4. The method defined by claim 3 wherein (a) is a gelled pig comprising a hydroxypropyl guar gum crosslinked with borate ions.

5. The method defined by claim 1 wherein (b) is an alkanol thickened with hydroxyethyl or hydroxypropyl cellulose.

6. The method defined by claim 5 wherein (b) is an alkanol thickened with hydroxypropyl cellulose.

7. The method defined by claim 1 wherein (c) is methanol, ethanol, or isopropanol.

8. The method defined by claim 1 wherein said alkanol in (b) and (c) is the same in each instance and is methanol, ethanol, or isopropanol.

9. A method of drying the interior surface of a pipeline comprising sequentially passing through said pipeline:

(a) an aqueous crosslinked gelled pig comprising an aqueous gelled guar gum or hydroxypropyl guar grum crosslinked with borate, titanate or zirconium ions, (b) a fluid mobility buffer comprising methanol, ethanol, or isopropanol thickened with hydroxypropyl cellulose, and (c) methanol, ethanol or isopropanol.

10. The method defined by claim 9 wherein (a) is an aqueous pig comprising a hydroxypropyl guar gum crosslinked with borate ions, (b) is methanol thickened with hydroxypropyl cellulose, and (c) is methanol.

* * * * *